US006637228B2

(12) United States Patent
Umemura et al.

(10) Patent No.: US 6,637,228 B2
(45) Date of Patent: Oct. 28, 2003

(54) CONTROL VALVE OF VARIABLE DISPLACEMENT COMPRESSOR

(75) Inventors: Satoshi Umemura, Kariya (JP); Tatsuya Hirose, Kariya (JP); Kazuhiko Minami, Kariya (JP); Yuji Hashimoto, Kariya (JP); Masami Niwa, Kariya (JP); Masaki Ota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/079,714

(22) Filed: Feb. 19, 2002

(65) Prior Publication Data

US 2002/0112493 A1 Aug. 22, 2002

(30) Foreign Application Priority Data

Feb. 20, 2001 (JP) ..... 2001-043595

(51) Int. Cl.[7] ..... F25B 1/00; F04B 1/26

(52) U.S. Cl. ..... 62/228.3; 417/222.2; 251/129.02

(58) Field of Search ..... 251/337, 129.02; 62/228.3, 228.5; 417/222.2

(56) References Cited

U.S. PATENT DOCUMENTS 6,126,406 A * 10/2000 Kawaguchi et al. ..... 417/222.2
6,311,950 B1 * 11/2001 Kappel et al. ..... 251/129.06
6,434,956 B1 * 8/2002 Ota et al. ..... 62/133
2001/0027658 A1 * 10/2001 Ota et al. ..... 62/228.3

FOREIGN PATENT DOCUMENTS

JP 11-201054 7/1999 ..... F04B/49/08

OTHER PUBLICATIONS

U.S. patent application Ser. No. 09/632,964, filed Aug. 4, 2000.

* cited by examiner

*Primary Examiner*—William Wayner
(74) *Attorney, Agent, or Firm*—Morgan & Finnegan, LLP

(57) ABSTRACT

A control valve is used for a variable displacement compressor installed in a refrigerant circuit of an air conditioner. The compressor has a control chamber and a control passage, which connects the control chamber to a pressure zone in which the pressure is different from the pressure of the control chamber. The control valve has a valve body, which is accommodated in the valve chamber for adjusting the opening size of the control passage. A pressure sensing member moves in accordance with the pressure difference between two pressure monitoring points located in the refrigerant circuit. The pressure sensing member moves the valve body such that the displacement of the compressor is varied to counter changes of the pressure difference. The force applied by an actuator corresponds to a target value of the pressure difference. The pressure sensing member moves the valve body such that the pressure difference seeks the target value. An urging member is accommodated in the valve chamber. The urging member urges the valve body in a direction to open the control passage.

21 Claims, 5 Drawing Sheets

CONTROL VALVE OF VARIABLE DISPLACEMENT COMPRESSOR

BACKGROUND OF THE INVENTION

The present invention relates to a control valve for controlling the displacement of a variable displacement compressor used in a vehicular air conditioner.

A typical refrigerant circuit in a vehicle air conditioner includes a condenser, an expansion valve, which functions as a decompression device, an evaporator and a compressor. The compressor draws refrigerant gas from the evaporator, then, compresses the gas and discharges the compressed gas to the condenser. The evaporator performs heat exchange between the refrigerant in the refrigerant circuit and the air in the passenger compartment. The heat of air at the evaporator is transmitted to the refrigerant flowing through the evaporator in accordance with the thermal load or the cooling load. Therefore, the pressure of refrigerant gas at the outlet of or the downstream portion of the evaporator represents the cooling load.

Variable displacement compressors are widely used in vehicles. Such compressors include a displacement control mechanism that operates to maintain the pressure at the outlet of the evaporator, or the suction pressure, at a predetermined target level (target suction pressure). The displacement control mechanism feedback controls the displacement of the compressor, or the inclination angle of a swash plate, by referring to the suction pressure such that the flow rate of refrigerant in the refrigerant circuit corresponds to the cooling load.

A typical displacement control mechanism includes a displacement control valve, which is called an internally controlled valve. The internally controlled valve detects the suction pressure by means of a pressure sensitive member such as a bellows or a diaphragm. The internally controlled valve moves a valve body by means of displacement of the pressure sensing member to adjust the valve opening degree. Accordingly, the pressure changes in a swash plate chamber (a crank chamber), which changes the inclination of the swash plate.

However, an internally controlled valve that has a simple structure and a single target suction pressure cannot respond to subtle changes in air conditioning demands. Therefore, control valves having a target suction pressure that can be changed by external electric current are also used. A typical electrically controlled control valve includes an electromagnetic actuator, which generates an electrically controlled force. The actuator changes the force acting on the pressure sensing member, thereby changing the target suction pressure.

In a displacement control procedure in which the suction pressure is used as a reference, changing of the target suction pressure by electrical control does not always quickly change the actual suction pressure to the target suction pressure. This is because whether the actual suction pressure quickly seeks a target suction pressure when the target suction pressure is changed greatly depends on the magnitude of the cooling load at the evaporator. Therefore, even if the target suction pressure is finely and continuously controlled by controlling the current to the control valve, changes in the compressor displacement are likely to be too slow or too sudden.

SUMMARY OF THE INVENTION

Accordingly, it is an objective of the present invention to provide a control valve of a variable displacement compressor that accurately controls the displacement of a compressor and improves the response of displacement control.

To achieve the foregoing and other objectives and in accordance with the purpose of the present invention, a control valve is provided. The control valve is used for a variable displacement compressor installed in a refrigerant circuit of an air conditioner. The compressor has a control chamber and a control passage, which connects the control chamber to a pressure zone in which the pressure is different from the pressure of the control chamber. The displacement of the compressor is varied in accordance with the pressure of the control chamber. The control valve comprises a valve housing, a valve chamber, a valve body, a pressure sensing member, an actuator, and an urging member. The valve chamber is defined in the valve housing to form a part of the control passage. The valve body is accommodated in the valve chamber for adjusting the opening size of the control passage. The pressure sensing member moves in accordance with the pressure difference between two pressure monitoring points located in the refrigerant circuit. The pressure sensing member moves the valve body such that the displacement of the compressor is varied to counter changes of the pressure difference. The actuator applies force to the valve body in accordance with external commands. The force applied by the actuator corresponds to a target value of the pressure difference. The pressure sensing member moves the valve body such that the pressure difference seeks the target value. The urging member is accommodated in the valve chamber. The urging member urges the valve body in a direction to open the control passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
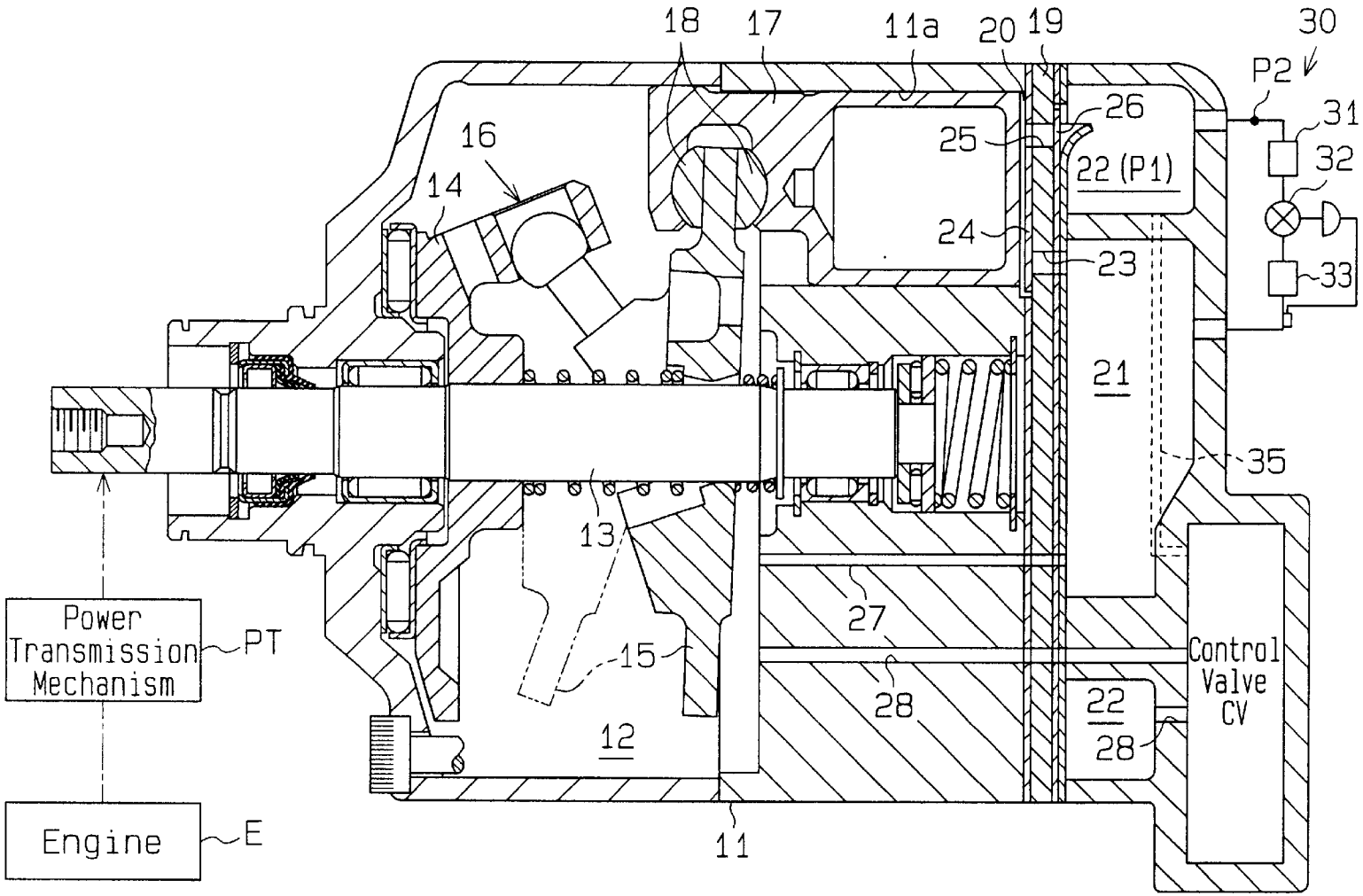
FIG. 1 is a cross-sectional view illustrating a variable displacement swash plate type compressor according to one embodiment of the present invention.

A vehicular air conditioner CV according to a first embodiment of the present invention will now be described with reference to FIGS. 1 and 2.

A control chamber, which is a crank chamber 12 in this embodiment, is defined in a housing 11 of the compressor. A drive shaft 13 extends through the crank chamber 12 and is rotatably supported. The drive shaft 13 is connected to and driven by a vehicle engine E through a power transmission mechanism PT. In FIG. 1, the left end of the compressor is defined as the front end, and the right end of the compressor is defined as the rear end.

In this embodiment, the power transmission mechanism PT is a clutchless mechanism that includes, for example, a belt and a pulley. The power transmission mechanism PT therefore constantly transmits power from the engine E to the compressor when the engine E is running. Alternatively, the mechanism PT may be a clutch mechanism (for example, an electromagnetic clutch) that selectively transmits power when supplied with a current.

A lug plate 14 is located in the crank chamber 12 and is secured to the drive shaft 13 to rotate integrally with the drive shaft 13. A drive plate, which is a swash plate 15 in this embodiment, is located in the crank chamber 12. The swash plate 15 slides along the drive shaft 13 and inclines with respect to the axis of the drive shaft 13. A hinge mechanism 16 is provided between the lug plate 14 and the swash plate 15. The hinge mechanism 16 and the lug plate 14 cause the swash plate 15 to rotate integrally with the drive shaft 13, and to incline with respect to the axis of the drive shaft 13.

Cylinder bores 11*a* (only one shown) are formed in the housing 11. A single headed piston 17 is reciprocally accommodated in each cylinder bore 11*a*. Each piston 17 is coupled to the peripheral portion of the swash plate 15 by a pair of shoes 18. Therefore, when the swash plate 15 rotates with the drive shaft 13, the shoes 18 convert the rotation of the swash plate 15 into reciprocation of the pistons 17.

A valve plate assembly 19 is located in the rear portion of the housing 11. A compression chamber 20 is defined in each cylinder bore 11*a* by the associated piston 17 and the valve plate assembly 19. A suction chamber 21, which is part of a suction pressure zone, and a discharge chamber 22, which is part of a discharge pressure zone, or a high pressure zone, are defined in the rear portion of the housing 11. The valve plate assembly 19 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 11*a*.

When each piston 17 moves from the top dead center position to the bottom dead center position, refrigerant gas in the suction chamber 21 is drawn into the corresponding cylinder bore 11*a* via the corresponding suction port 23 and suction valve 24. When each piston 17 moves from the bottom dead center position to the top dead center position, refrigerant gas in the corresponding cylinder bore 11*a* is compressed to a predetermined pressure and is discharged to the discharge chamber 22 via the corresponding discharge port 25 and discharge valve 26.

As shown in FIG. 1, a bleed passage 27 and a supply passage 28 are formed in the housing 11. The bleed passage 27 connects the crank chamber 12 with the suction chamber 21.

The supply passage 28 connects the discharge chamber 22 with the crank chamber 12. The supply passage 28 is regulated by the control valve CV.

The degree of opening of the control valve CV is changed for controlling the relationship between the flow rate of high-pressure gas flowing into the crank chamber 12 through the supply passage 28 and the flow rate of gas flowing out of the crank chamber 12 through the bleed passage 27. The crank chamber pressure is determined accordingly. In accordance with a change in the pressure in the crank chamber 12, the difference between the crank chamber pressure and the pressure in each compression chamber 20 is changed, which alters the inclination angle of the swash plate 15. As a result, the stroke of each piston 17, that is, the discharge displacement, is controlled.

For example, when the pressure in the crank chamber 12 is lowered, the inclination angle of the swash plate 15 is increased and the compressor displacement is increased accordingly. When the crank chamber pressure is raised, the inclination angle of the swash plate 15 is decreased and the compressor displacement is decreased accordingly.

As shown in FIG. 1, the refrigerant circuit of the vehicular air conditioner includes the compressor and an external refrigerant circuit 30. The external refrigerant circuit 30 includes a condenser 31, a decompression device, which is an expansion valve 32 in this embodiment, and an evaporator 33. In this embodiment, carbon dioxide is used as the refrigerant.

A first pressure monitoring point P1 is located in the discharge chamber 22. A second pressure monitoring point P2 is located in the refrigerant passage at a part that is spaced downstream from the first pressure monitoring point P1 toward the condenser 31 by a predetermined distance. The first pressure monitoring point P1 is connected to the control valve CV through a first pressure introduction passage 35. The second pressure monitoring point P2 is connected to the control valve CV through a second pressure introduction passage 36 (see FIG. 2).

Figure 2:
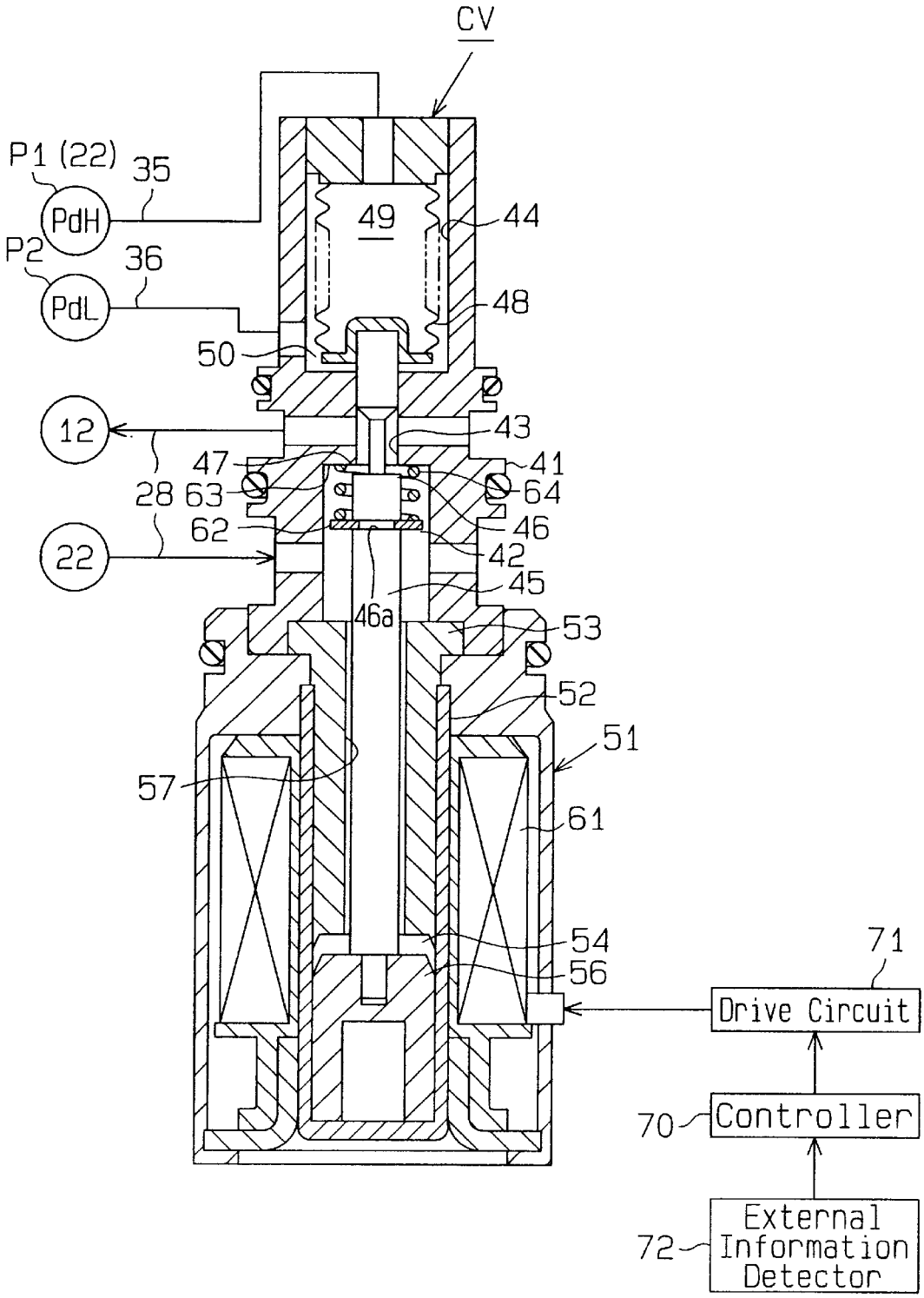
FIG. 2 is a cross-sectional view illustrating the control valve in the compressor of FIG. 1.

As shown in FIG. 2, the control valve CV has a valve housing 41. A valve chamber 42, a communication passage 43, and a pressure sensing chamber 44 are defined in the valve housing 41. A transmission rod 45 extends through the valve chamber 42 and the communication passage 43. The transmission rod 45 moves in the axial direction, or in the vertical direction as viewed in the drawing. The upper portion of the transmission rod 45 is slidably fitted in the communication passage 43.

The communication passage 43 is disconnected from the pressure sensing chamber 44 by the upper portion of the transmission rod 45. The valve chamber 42 is connected to the discharge chamber 22 through an upstream section of the supply passage 28. The communication passage 43 is connected to the crank chamber 12 through a downstream section of the supply passage 28. The valve chamber 42 and the communication passage 43 form a part of the supply passage 28.

A cylindrical valve body 46 is formed in the middle portion of the transmission rod 45 and is located in the valve chamber 42. A step defined between the valve chamber 42 and the communication passage 43 functions as a valve seat 47.

When the transmission rod 45 is moved from the position of FIG. 2, or the lowermost position, to the uppermost position, at which the valve body 46 contacts the valve seat 47, the communication passage 43 is disconnected from the valve chamber 42. That is, the valve body 46 controls the opening degree of the supply passage 28.

An annular groove 46*a* is formed on the outer surface of the valve body 46 in the valve chamber 42. A first spring seat, which is a snap ring 62 in this embodiment, is fitted to the groove 46*a*. Part of the ceiling of the valve chamber 42 that surrounds the lower opening of the communication passage 43 functions as a spring seat 63, or a second spring seat. A coil spring 64 is located between the spring seat 63 and the snap ring 62. The spring 64 urges the valve body 46 in the direction opening the communication passage 43.

A pressure sensing member, which is a bellows 48 in this embodiment, is located in the pressure sensing chamber 44. The upper end of the bellows 48 is fixed to the valve housing 41. The lower end (movable end) of the bellows 48 receives the upper end of the transmission rod 45. The bellows 48 divides the pressure sensing chamber 44 into a first pressure chamber 49, which is the interior of the bellows 48, and a second pressure chamber 50, which is the exterior of the bellows 48. The first pressure chamber 49 is connected to the first pressure monitoring point P1 through a first pressure introduction passage 35. The second pressure chamber 50 is connected to the second pressure monitoring point P2 through a second pressure introduction passage 36. Therefore, the first pressure chamber 49 is exposed to the pressure PdH monitored at the first pressure monitoring point P1, and the second pressure chamber 50 is exposed to the pressure PdL monitored at the second pressure monitoring point P2. The bellows 48 and the pressure sensing chamber 44 form a pressure sensing mechanism.

A target pressure difference changing means, which is an electromagnetic actuator 51 in this embodiment, is located at the lower portion of the valve housing 41. The electromagnetic actuator 51 includes a cup-shaped cylinder 52. The cylinder 52 is located at the axial center of the valve housing 41. A cylindrical stationary iron core 53 is fitted in the upper opening of the cylinder 52. The stationary core 53 defines a plunger chamber 54 in the cylinder 52, and separates the valve chamber 42 from the plunger chamber 54.

A movable core 56, which is shaped like an inverted cup, is located in the plunger chamber 54. The movable iron core 56 slides along the inner wall of the cylinder 52 in the axial direction. An axial guide hole 57 is formed in the center of the stationary iron core 53. The lower portion of the transmission rod 45 is slidably supported by the guide hole 57. The lower end of the transmission rod 45 is fixed to the movable iron core 56. The movable iron core 56 moves integrally with the transmission rod 45.

The valve chamber 42 is connected to the plunger chamber 54 through a clearance created between the guide hole 57 and the transmission rod 45 (In the drawings, the space is exaggerated for purposes of illustration). The plunger chamber 54 is therefore exposed to the discharge pressure of the valve chamber 42. Since the space between the transmission rod 45 and the guide hole 57 is used as a passage, there is no need for forming a passage for connecting the valve chamber 42 with the plunger chamber 54. Although not discussed in detail, exposing the plunger chamber 54 to the pressure in the valve chamber 42 improves the operation characteristics of the control valve CV, or the valve opening degree control characteristics.

A coil 61 is located about the stationary iron core 53 and the movable iron core 56. The coil 61 is connected to a drive circuit 71, and the drive circuit 71 is connected to a controller 70. The controller 70 is connected to an external information detector 72. The controller 70 receives external information (on-off state of the air conditioner, the temperature of the passenger compartment, and a target temperature) from the detector 72. Based on the received information, the controller 70 commands the drive circuit 71 to supply a drive signal to the coil 61.

The coil 61 generates an electromagnetic force, the magnitude of which depends on the value of the externally supplied electric current, between the movable iron core 56 and the stationary iron core 53. The value of the current supplied to the coil 61 is controlled by controlling the voltage applied to the coil 61. The applied voltage is controlled by pulse-width modulation (PWM).

(Operation Characteristics of Control Valve)

The position of the transmission rod 45 (the valve body 46), or the valve opening of the control valve CV, is controlled in the following manner.

As shown in FIG. 2, when the coil 61 is supplied with no electric current (duty ratio=0%), the position of the transmission rod 45 is dominantly determined by the downward force of the bellows 48 and the downward force of the spring 64. Thus, the transmission rod 45 is placed at its lowermost position, and the communication passage 43 is fully opened. The difference between the pressure in the crank chamber 12 and the pressure in the compression chambers 20 thus becomes great. As a result, the inclination angle of the swash plate is minimized, and the discharge displacement of the compressor is also minimized.

When a current of a minimum duty ratio, which is greater than 0%, is supplied to the coil 61 of the control valve CV, the upward electromagnetic force surpasses the resultant of the downward forces of the bellows 48 and the spring 64, which moves the transmission rod 45 upward. In this state, the upward electromagnetic force acts against the resultant of the force based on the pressure difference ΔPd (ΔPd=PdH−PdL) and the downward forces of the bellows 48 and the spring 64. The position of the valve body 46 of the transmission rod 45 relative to the valve seat 47 is determined such that upward and downward forces are balanced.

For example, if the flow rate of the refrigerant in the refrigerant circuit is decreased due to a decrease in speed of the engine E, the downward force based on the pressure difference ΔPd decreases, and the electromagnetic force cannot balance the forces acting on the transmission rod 45. Therefore, the transmission rod 45 (the valve body 46) moves upward. This decreases the opening degree of the communication passage 43 and thus lowers the pressure in the crank chamber 12. Accordingly, the inclination angle of the swash plate 15 is increased, and the displacement of the compressor is increased. The increase in the displacement of the compressor increases the flow rate of the refrigerant in the refrigerant circuit, which increases the pressure difference ΔPd.

In contrast, when the flow rate of the refrigerant in the refrigerant circuit is increased due to an increase in the speed of the engine E, the downward force based on the pressure difference ΔPd increases and the current electromagnetic force cannot balance the forces acting on the transmission rod 45. Therefore, the transmission rod 45 (the valve body 46) moves downward and increases the opening degree of the communication passage 43. This increases the pressure in the crank chamber 12. Accordingly, the inclination angle of the swash plate 15 is decreased, and the displacement of the compressor is also decreased. The decrease in the displacement of the compressor decreases the flow rate of the refrigerant in the refrigerant circuit, which decreases the pressure difference ΔPd.

When the duty ratio of the electric current supplied to the coil 61 is increased to increase the electromagnetic force, the pressure difference ΔPd cannot balance the forces acting on the transmission rod 45. Therefore, the transmission rod 45 (the valve body 46) moves upward and decreases the opening degree of the communication passage 43. As a result, the displacement of the compressor is increased. Accordingly, the flow rate of the refrigerant in the refrigerant circuit is increased and the pressure difference ΔPd is increased.

When the duty ratio of the electric current supplied to the coil 61 is decreased and the electromagnetic force is decreased accordingly, the pressure difference ΔPd cannot balance the forces acting on the transmission rod 45.

Therefore, the transmission rod 45 (the valve body 46) moves downward, which increases the opening degree of the communication passage 43. Accordingly, the compressor displacement is decreased. As a result, the flow rate of the refrigerant in the refrigerant circuit is decreased, and the pressure difference ΔPd is decreased.

As described above, the target value of the pressure difference ΔPd is determined by the duty ratio of current supplied to the coil 61. The control valve CV automatically determines the position of the transmission rod 45 (the valve body 46) according to changes of the pressure difference ΔPd to maintain the target value of the pressure difference ΔPd. The target value of the pressure difference ΔPd is externally controlled by adjusting the duty ratio of current supplied to the coil 61.

The above illustrated embodiment has the following advantages.

(1) The suction pressure, which is influenced by the thermal load in the evaporator 33, is not directly referred to for controlling the opening of the control valve CV. Instead, the pressure difference ΔPd between the pressure monitoring points P1 and P2 in the refrigerant circuit is directly controlled for feedback controlling the displacement of the compressor. Therefore, the displacement is scarcely influenced by the thermal load of the evaporator 33. In other words, the displacement is quickly and accurately controlled by external control of the controller 70.

Figure 7:
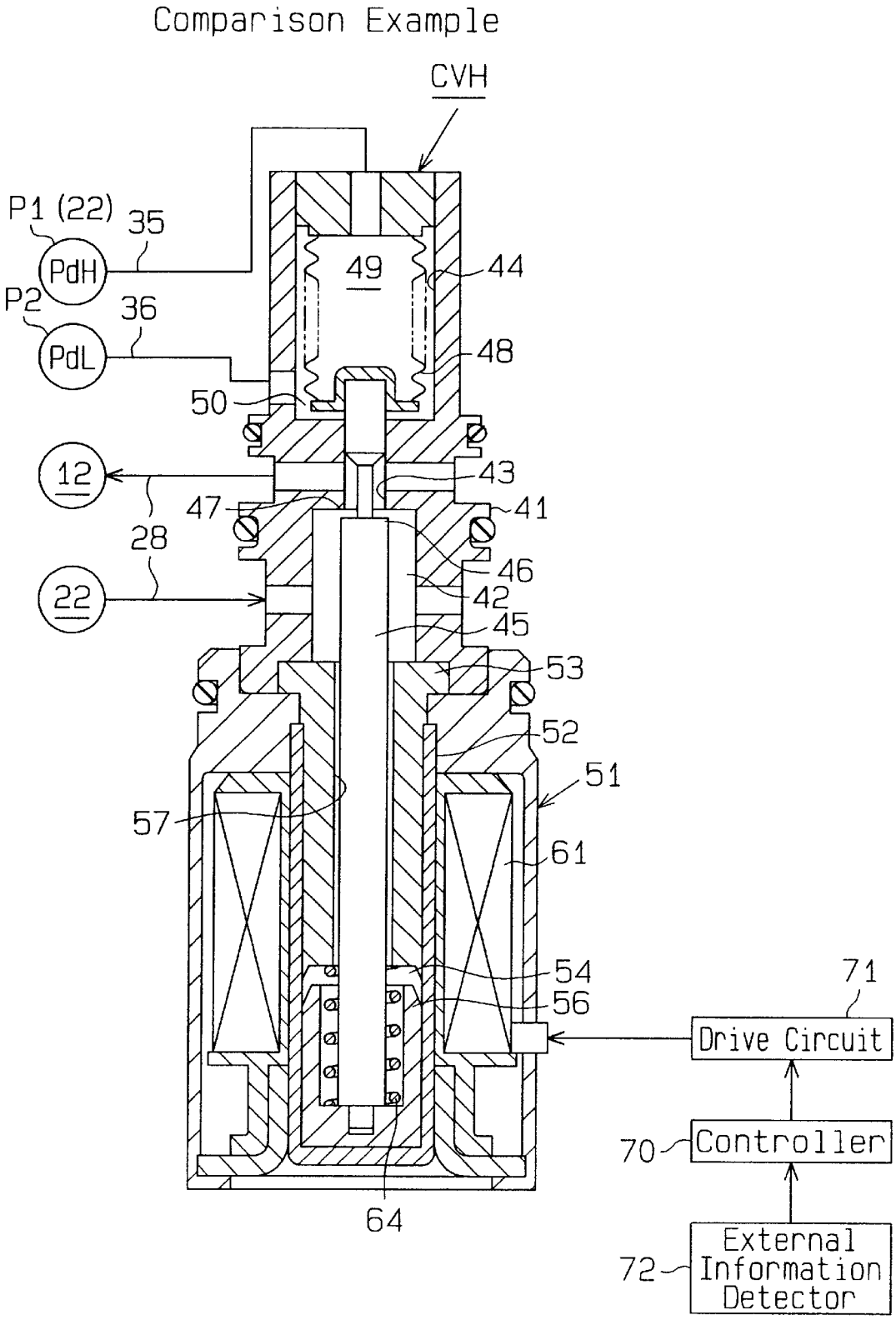
FIG. 7 is a cross-sectional view illustrating a control valve of a comparison example.

(2) FIG. 7 illustrates a control valve CVH of a comparison example. A major difference of the control valve CVH of the comparison example from the control valve CV of the above embodiment is that the spring 64 is located in the plunger chamber 54 and the spring 64 urges the valve body 46 in the opening direction through the movable iron core 56. Therefore, the movable iron core 56 is cup shaped so that the spring 64 can be accommodated in the plunger chamber 54. That is, the space for accommodating the spring 64 opens to the stationary iron core 53. Thus, the movable iron core 56 has a large space, or recess, at a part facing the stationary iron core 53 for accommodating the spring 64. This narrows the magnetic path between the stationary iron core 53 and the movable iron core 56, which weakens the electromagnetic force generated by the electromagnetic actuator 51.

However, in control valve CV of the above embodiment, the spring 64 is located in the valve chamber 42. In other words, the movable iron core 56 does not have to receive the spring 64 directly. This structure adds to the flexibility of the design of the movable iron core 56. Thus, the movable iron core 56 is shaped like an inverted cup. That is, the area of part of the movable iron core 56 that faces the stationary core 53 is large. This widens the magnetic path between the movable iron core 56 and the stationary iron core 53. Therefore, given the same current to the coil 61, the control valve CV generates a greater electromagnetic force at the electromagnetic actuator 51 than that of the control valve CVH. In other words, the control valve CV requires a low current for controlling the target pressure difference.

It is possible to replace the function of the spring 64 by the bellows 48. In this case, however, the operation characteristics of the bellows 48, or the expansion and contraction property according to changes in the pressure difference ΔPd, cannot be optimally set. Therefore, replacing the function of the spring 64 by the bellows 48 is not preferable.

(3) The snap ring 62, which functions as a spring seat, is independent from the valve body 46. The spring seat may be integrally formed with the valve body 46 without departing from the concept of the present invention. However, the above embodiment, in which the snap ring 62 is a separate member, the valve body 46 has a simple cylindrical shape and is thus easy to manufacture.

(4) The spring seat is formed with the snap ring 62. The snap ring 62 is easily attached to the valve body 46.

(5) The upper end of the transmission rod 45 is slidably supported by the communication passage 43. The movable iron core 56 is fixed to the lower end of the transmission rod 45. Therefore, the lower end of the transmission rod 45 is slidably supported by the inner wall of the cylinder 52 through the movable iron core 56. A space is created between the guide hole 57 and the transmission rod 45.

The integrated member having the transmission rod 45 and the movable iron core 56 is supported at two locations, that is, at the upper end and the lower end. Therefore, compared to a case where the middle portion of the transmission rod 45 is slidably supported by the guide hole 57, the integrated member is stably supported. The structure also prevents the integrated member from being inclined and thus reduces the friction acting on the transmission rod 45. As a result, hysteresis is prevented in the control valve CV.

A control valve CV according to a second embodiment of the present invention will now be described with reference to FIG. 3. The description of the second embodiment will focus on the differences from the embodiment of FIGS. 1 and 2, and the same reference numbers are used to refer to parts that are similar to those in the embodiment of FIGS. 1 and 2.

Figure 3:
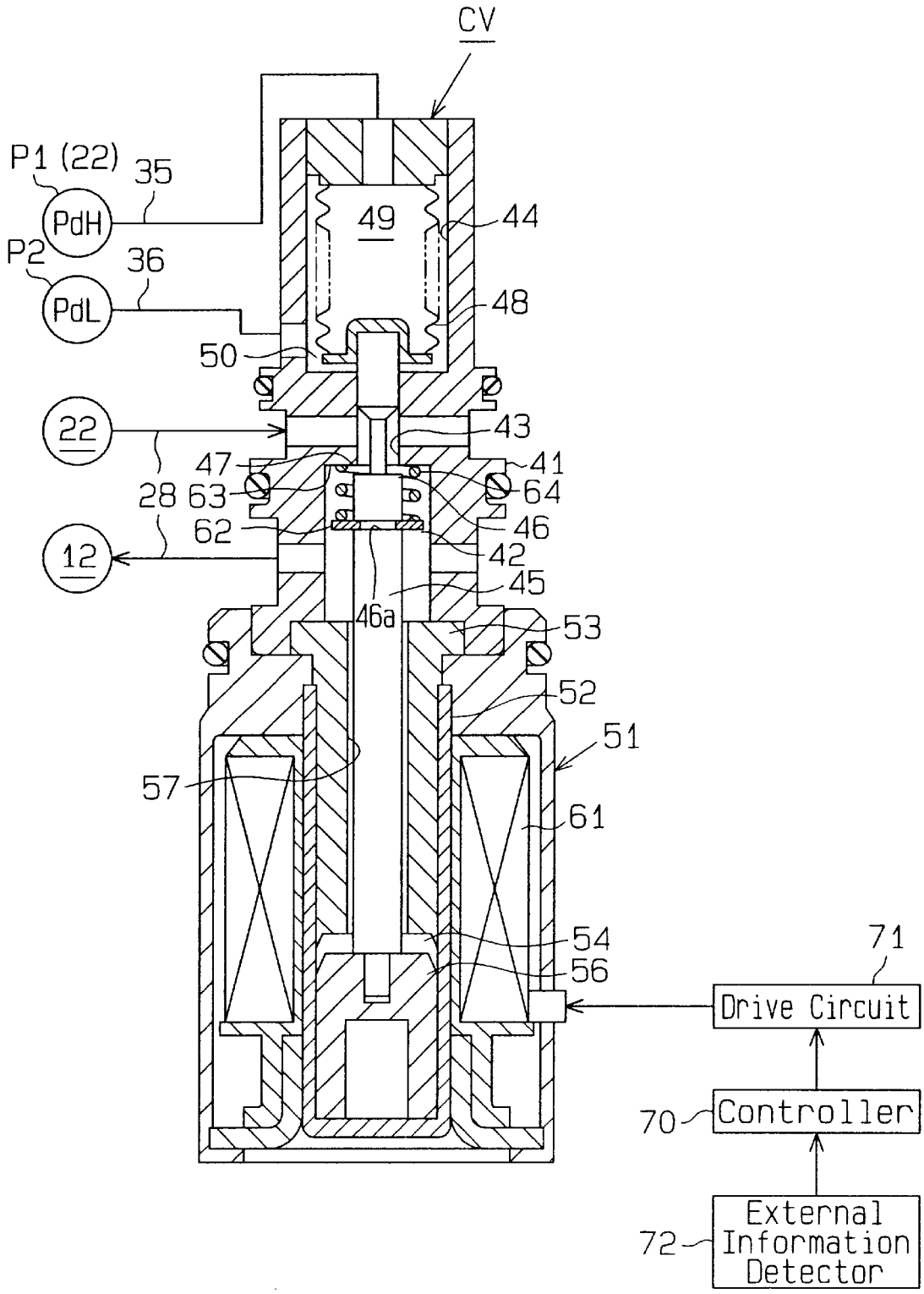
FIG. 3 is a cross-sectional view illustrating a control valve according to a second embodiment.

In the control valve CV shown in FIG. 3, the valve chamber 42 is connected to the crank chamber 12 through the downstream section of the supply passage 28 and is connected to the discharge chamber 22 through the upstream section of the supply passage 28. This structure reduces the pressure difference between the second pressure chamber 50 and the communication passage 43, which are adjacent to each other. Accordingly, refrigerant is prevented from leaking between the communication passage 43 and the second pressure chamber 50 and thus permits the compressor displacement to be accurately controlled.

In the embodiment of FIG. 3, the discharge pressure, which is introduced into the communication passage 43, acts on the valve body 46 against the electromagnetic force of the electromagnetic actuator 51. Therefore, when the valve body 46 fully closes the communication passage 43, the electromagnetic force of the actuator 51 must be stronger than the embodiment of FIG. 2. However, unlike the control valve CVH of the comparison example in FIG. 7, the spring 64 is located in the valve chamber 42. That is, the movable iron core 56 need not receive the spring 64 directly. Thus, the movable iron core 56 is shaped like an inverted cup, which widens the magnetic path between the movable iron core 56 and the stationary iron core 53. That is, as mentioned in the advantage (2) of the embodiment shown in FIGS. 1 and 2, the structure of FIG. 3 adds to the flexibility of the design of the movable iron core 56 compared to the control valve CVH shown in FIG. 7. In other words, the magnetic path between the movable iron core 56 and the stationary iron core 53 is increased. Hence, the application of the present invention to the control valve CV of FIG. 3 is particularly advantageous.

A control valve CV according to a third embodiment of the present invention will now be described with reference to FIG. 4. The description of the third embodiment will focus on the differences from the embodiment of FIGS. 1 and 2, and the same reference numbers are used to refer to parts that are similar to those in the embodiment of FIGS. 1 and 2.

Figure 4:
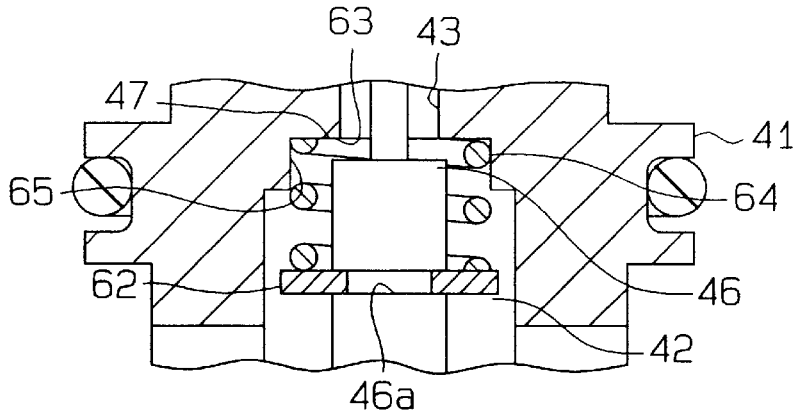
FIG. 4 is an enlarged cross-sectional view illustrating a control valve according to a third embodiment.

In the third embodiment, a small diameter portion 65 is formed in the valve chamber 42 about the spring seat 63 as shown in FIG. 4. The diameter of the small diameter portion 65 is substantially the same as the outer diameter of the spring 64 so that the upper end of the spring 64 is held by the small diameter portion 65. This structure prevents the spring 64 from being displaced in a direction perpendicular to the axis of the valve housing 41. In other words, the spring 64 is prevented from coming off the snap ring 62 and the spring seat 63. Particularly, preventing the spring 64 from coming off the spring seat 63 is advantageous for permitting refrigerant to smoothly flow between the communication passage 43 and the valve chamber 42. The structure of FIG. 4 is therefore permits the compressor displacement to be accurately controlled.

Figure 5:
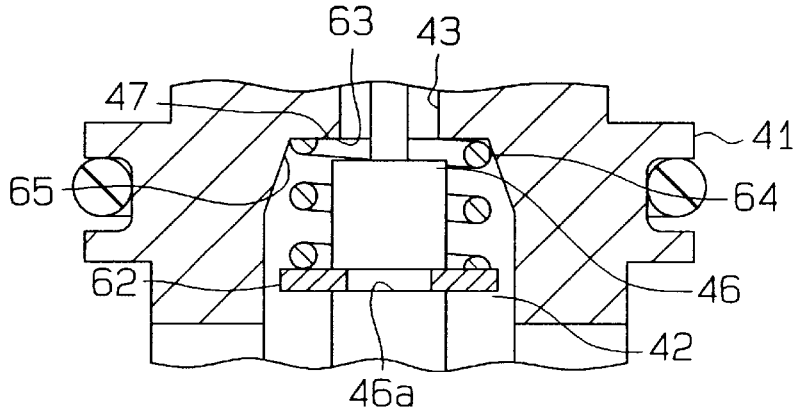
FIG. 5 is an enlarged cross-sectional view illustrating a control valve according to a fourth embodiment.

A control valve CV according to a fourth embodiment of the present invention will now be described with reference to FIG. 5. The description of the fourth embodiment will focus on the differences from the embodiment of FIG. 4, and the same reference numbers are used to refer to parts that are similar to those in the embodiment of FIG. 4.

In the fourth embodiment, the small diameter portion 65 is tapered such that the diameter is reduced toward the spring seat 63. When assembling the spring 64 with the valve housing 41, the tapered structure guides the spring 64 to the valve seat, which facilitates the assembly.

A control valve CV according to a fifth embodiment of the present invention will now be described with reference to FIG. 6. The description of the fourth embodiment will focus on the differences from the embodiment of FIGS. 1 and 2, and the same reference numbers are used to refer to parts that are similar to those in the embodiment of FIGS. 1 and 2.

Figure 6:
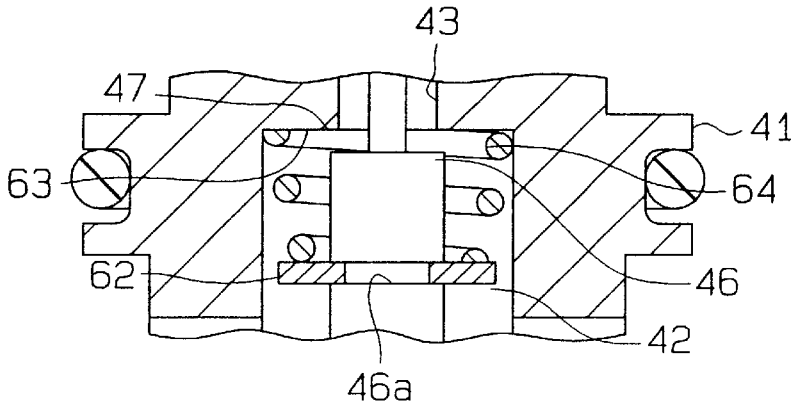
FIG. 6 is an enlarged cross-sectional view illustrating a control valve according to a fifth embodiment.

In the embodiment of FIG. 6, the spring 64 is a conical spring, diameter of which increases toward the spring seat 63. This structure stabilizes the spring 64 without complicating the shape of the valve chamber 42 like the small diameter portion 65 shown in FIG. 5. The embodiment of FIG. 6 has the same advantages as the embodiment of FIG. 4.

It should be apparent to those skilled in the art that the present invention may be embodied in many other specific forms without departing from the spirit or scope of the invention. Particularly, it should be understood that the invention may be embodied in the following forms.

The first pressure monitoring point P1 may be located in the suction pressure zone between the evaporator 33 and the suction chamber 21, and the second pressure monitoring point P2 may be located at a part downstream of the first pressure monitoring point P1 in the suction pressure zone.

The first pressure monitoring point P1 may be located in the discharge pressure zone between the discharge chamber 22 and the condenser 31, and the second pressure monitoring point P2 may be located in the suction pressure zone, which includes the evaporator 33 and the suction chamber 21.

The first pressure monitoring point P1 may be located in the discharge pressure zone between the discharge chamber 22 and the condenser 31, and the second pressure monitoring point P2 may be located in the crank chamber 12. Alternatively, the second pressure monitoring point P2 may be located in the crank chamber 12, and the first pressure monitoring point P1 may be located in the suction pressure zone, which includes the evaporator 33 and the suction chamber 21. Unlike the embodiments of FIGS. 1 to 6, the locations of the pressure monitoring points P1 and P2 are not limited to the main circuit of the refrigerant circuit, which includes the evaporator 33, the suction chamber 21, the compression chambers 20, the discharge chamber 22, and the condenser 31. For example, the pressure monitoring points PI, P2 may be located in an intermediate pressure zone, or the crank chamber 12, in a sub-circuit of the refrigerant circuit, which includes the supply passage 28, the crank chamber 12, and the bleed passage 27.

The control valve CV may be used as a bleed control valve for controlling the pressure in the crank chamber 12 by controlling the opening of the bleed passage 27.

The present invention may be embodied in a control valve of a wobble type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit of an air conditioner, wherein the compressor has a control chamber and a control passage, which connects the control chamber to a pressure zone in which the pressure is different from the pressure of the control chamber, wherein the displacement of the compressor is varied in accordance with the pressure of the control chamber, the control valve comprising:

a valve housing;

a valve chamber defined in the valve housing to form a part of the control passage;

a valve body, which is accommodated in the valve chamber for adjusting the opening size of the control passage;

a pressure sensing member, which moves in accordance with the pressure difference between two pressure monitoring points located in the refrigerant circuit, wherein the pressure sensing member moves the valve body such that the displacement of the compressor is varied to counter changes of the pressure difference;

a transmission rod for moving the valve body;

an actuator for applying force to the valve body via the transmission rod in accordance with external commands, wherein the force applied by the actuator corresponds to a target value of the pressure difference, wherein the pressure sensing member moves the valve body such that the pressure difference seeks the target value, wherein the actuator has a movable iron core, which is shaped like an inverted cup, and a stationary core, wherein the stationary core is located between the valve body and the movable core, wherein the movable iron core has a lid portion, wherein the lid portion faces to the stationary core; and an urging member accommodated in the valve chamber, wherein the urging member urges the valve body in a direction to open the control passage.

2. The control valve according to claim 1, wherein the valve body has a spring seat to receive an end of the urging member.

3. The control valve according to claim 2, wherein the spring seat is independent from the valve body.

4. The control valve according to claim 3, wherein the spring seat is a snap ring.

5. The control valve according to claim 3, wherein the spring seat is a first spring seat, wherein a part of the valve housing that defines the valve chamber forms a second spring seat, which receives the other end of the urging member.

6. The control valve according to claim 5, wherein the valve chamber has a small diameter portion around the second spring seat.

7. The control valve according to claim 6, wherein the small diameter portion is tapered such that the diameter is reduced toward the second spring seat.

8. The control valve according to claim 5, wherein the urging member is a coil spring, and wherein the diameter of the coil spring increases toward the second spring seat.

9. The control valve according to claim 1, wherein the refrigerant circuit has a high pressure zone, which is exposed to the pressure of refrigerant that is compressed, wherein the control passage is a supply passage, which connects the control chamber to the high pressure zone, and wherein the valve chamber is connected to the high pressure zone via an upstream section of the supply passage.

10. The control valve according to claim 9, wherein the two pressure monitoring points are located in the high pressure zone, and wherein one of the pressure monitoring points is downstream of the other pressure monitoring point.

11. The control valve according to claim 1, wherein the actuator applies electromagnetic force generated in accordance with the external commands to the valve body via the movable iron core and the transmission rod.

12. The control valve according to claim 11, wherein the actuator has a plunger chamber, which accommodates the movable iron core, wherein the transmission rod extends through the stationary core, and wherein the valve chamber is connected to the plunger chamber via a clearance created between the transmission rod and the stationary core.

13. The control valve according to claim 12, wherein the actuator generates electromagnetic force between the stationary core and the movable iron core to close the control passage in accordance with an externally supplied electric current.

14. The control valve according to claim 1, wherein the air conditioner is used in a vehicle, wherein the compressor is connected to an engine of the vehicle via a clutchless type power transmission mechanism.

15. A control valve used for a variable displacement compressor installed in a refrigerant circuit of an air conditioner, wherein the compressor has a control chamber and a control passage, which connects the control chamber to a pressure zone in which the pressure is different from the pressure of the control chamber, wherein the displacement of the compressor is varied in accordance with the pressure of the control chamber, the control valve comprising:

a valve housing;

a valve chamber defined in the valve housing to form a part of the control passage;

a transmission rod for moving along the axis direction of the valve housing, wherein the transmission rod has a valve body, which is accommodated in the valve chamber for adjusting the opening size of the control passage;

a pressure sensing member, which moves in accordance with the pressure difference between two pressure monitoring points located in the refrigerant circuit, wherein the pressure sensing member moves the valve body such that the displacement of the compressor is varied to counter changes of the pressure difference;

an actuator for applying force to the transmission rod in accordance with external commands, wherein the actuator has a movable iron core, which is shaped like an inverted cup, and a stationary core, wherein the stationary core is located between the valve body and the movable core, wherein the movable iron core has a lid portion, wherein the lid portion faces to the stationary core, wherein the force applied by the actuator corresponds to a target value of the pressure difference, wherein the pressure sensing member moves the valve body such that the pressure difference seeks the target value;

an urging member accommodated in the valve chamber, wherein the urging member urges the valve body in a direction to open the control passage; and a spring seat located on the transmission rod to hold an end of the urging member.

16. The control valve according to claim 15, wherein the spring seat is independent from the valve body.

17. The control valve according to claim 15, wherein the spring seat is a snap ring.

18. The control valve according to claim 15, wherein the spring seat is a first spring seat, wherein a part of the valve housing that defines the valve chamber forms a second spring seat, which receives the other end of the urging member.

19. The control valve according to claim 18, wherein the valve chamber has a small diameter portion around the second spring seat.

20. The control valve according to claim 19, wherein the small diameter portion is tapered such that the diameter is reduced toward the second spring seat.

21. The control valve according to claim 18, wherein the urging member is a coil spring, wherein the diameter of the coil spring increases toward the second spring seat.

* * * * *